United States Patent [19]

Anderson et al.

[11] 4,156,573

[45] * May 29, 1979

[54] TYPEWRITER RIBBON CARTRIDGE

[75] Inventors: Carl P. Anderson, Palo Alto, Calif.; Thomas E. Hanson, Syracuse, N.Y.

[73] Assignee: SCM Corporation, New York, N.Y.

[ * ] Notice: The portion of the term of this patent subsequent to Feb. 21, 1989, has been disclaimed.

[21] Appl. No.: 661,589

[22] Filed: Feb. 26, 1976

Related U.S. Application Data

[63] Continuation of Ser. No. 150,946, Jun. 9, 1971, abandoned, which is a continuation-in-part of Ser. No. 64,058, Jul. 23, 1970, Pat. No. 3,643,777, which is a continuation of Ser. No. 710,185, Mar. 4, 1968, abandoned.

[51] Int. Cl.[2] ..... B41J 33/14

[52] U.S. Cl. ..... 400/208; 400/196

[58] Field of Search ..... 197/151, 168, 170, 175, 197/153 R, 153 A

[56] References Cited

U.S. PATENT DOCUMENTS

| | | | |
|---|---|---|---|
| 539,683 | 5/1895 | Johns | 197/168 |
| 785,709 | 3/1905 | Burridge | 197/168 |
| 1,654,906 | 1/1928 | Waldheim | 197/170 X |
| 2,062,455 | 12/1936 | Henry | 197/153 R |
| 2,252,075 | 8/1941 | Johnson | 197/151 UX |
| 2,803,331 | 8/1957 | Berill | 197/153 R |
| 2,873,015 | 2/1959 | Gray | 197/151 |
| 2,883,029 | 4/1959 | Gray | 197/151 UX |
| 3,026,987 | 3/1962 | Gather | 197/153 R |
| 3,124,064 | 3/1964 | Schick | 197/151 X |
| 3,151,724 | 10/1964 | Ross et al. | 197/151 |
| 3,195,708 | 7/1965 | Biedinger | 197/175 |
| 3,311,316 | 3/1967 | Williams | 197/168 UX |
| 3,425,532 | 2/1969 | Dannatt | 197/151 |
| 3,590,221 | 6/1971 | Malkowski | 197/168 UX |
| 3,643,777 | 2/1972 | Anderson et al. | 197/151 |
| 3,643,778 | 2/1972 | Anderson | 197/151 |
| 3,643,779 | 2/1972 | Anderson et al. | 197/151 |

FOREIGN PATENT DOCUMENTS

| | | | |
|---|---|---|---|
| 1813193 | 8/1970 | Fed. Rep. of Germany | 197/151 |

*Primary Examiner*—Ernest T. Wright, Jr.

*Attorney, Agent, or Firm*—Milton Wolson; Ernest F. Weinberger

[57] ABSTRACT

A cartridge for housing a supply of ribbon for typewriters or like machines. The cartridge includes an arm extending therefrom to guide the ribbon from the cartridge to the typewriter print point and to reverse the direction of the ribbon for guiding the ribbon back to the cartridge which is supported on a machine rigid frame on one side of the print point. The arm is provided in several embodiments of the invention, with a tab-like extension near its end to be engaged by the typewriter lift mechanism whereby it may be driven by the lift mechanism to carry the ribbon from a point adjacent the print point to the print point as a ribbon vibrator.

18 Claims, 12 Drawing Figures

INVENTOR.
THOMAS E. HANSON
CARL P. ANDERSON
BY

INVENTOR.
THOMAS E. HANSON
CARL P. ANDERSON
BY

INVENTOR.
THOMAS E. HANSON
CARL P. ANDERSON

BY

TYPEWRITER RIBBON CARTRIDGE

BACKGROUND OF THE INVENTION

This is a continuation, of application Ser. No. 150,946, filed June 9, 1971 now abandoned which is a continuation-in-part of application Ser. No. 64,058 filed July 23, 1970 by applicants, now U.S. Pat. No. 3,643,777 which application was a continuation of application Ser. No. 710,185 filed Mar. 4, 1968, now abandoned.

This invention relates to ribbon cartridges, and more particularly to a cartridge for housing the ribbon in a typewriter or like printing machine.

Most ribbon spool cartridges for typewriter or like printing machines are of the two spool type wherein separate housings are provided for the spools but are joined in a side by side relationship either integrally or by a separate member. The integral joint or the separate joining member is usually provided with a weakened section for separating the spool housing so they may be placed in their respective machine supports after the ribbon is inserted in the machine vibrator.

Although this type of ribbon cartridge does provide a somewhat expedient method of typewriter ribbon installation, it is still time consuming and bothersome to the operator.

SUMMARY OF THE INVENTION

The present invention is comprised of a cartridge having two main portions, the first portion comprising a substantially enclosed housing which supports a supply of ribbon of either an endless loop type or a coaxially mounted double spool type. The other cartridge portion comprises an arm having means for first directing the ribbon from the housing to the print point and secondly for changing the direction of the ribbon to guide the ribbon back to the housing.

Therefore, the present ribbon cartridge, by providing a single unit for housing a supply of ribbon and directing the ribbon to and from a print point, need only be positioned within a suitable support in the machine to effect a ribbon installation thereby eliminating the aforementioned time consuming and bothersome steps needed for the separable type cartridge installation.

DESCRIPTION OF THE PREFERRED EMBODIMENT

Figure 1:
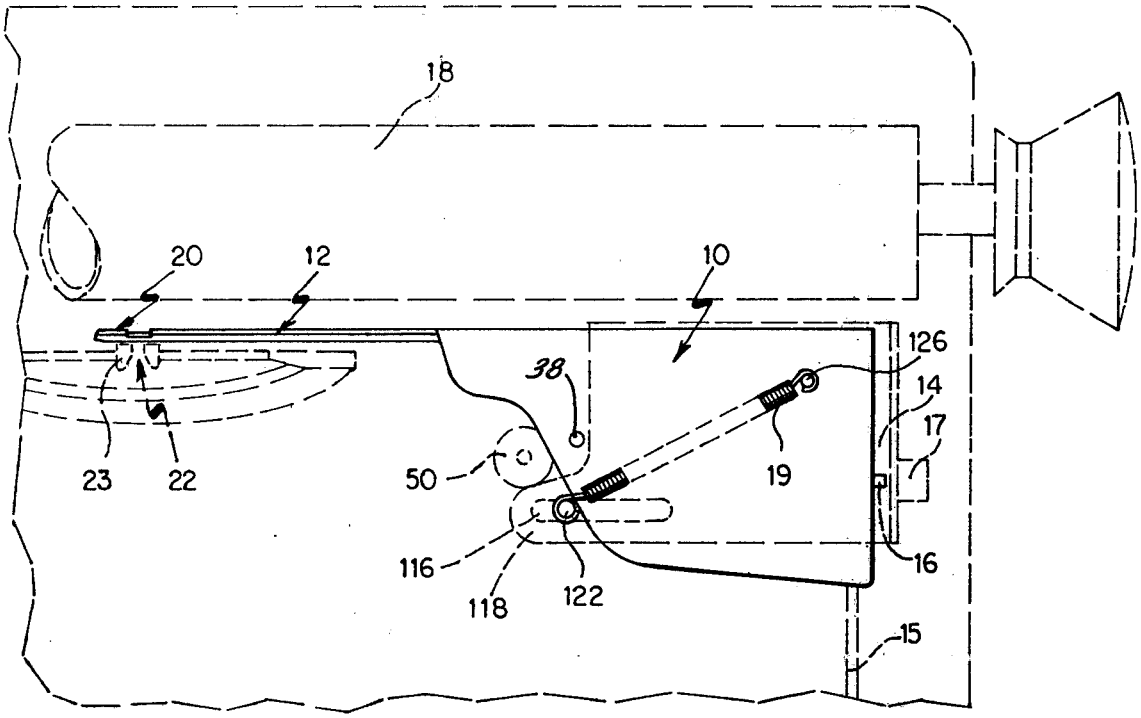
FIG. 1 is a top plan view of the present ribbon cartridge illustrating its position when in the typewriter.

Referring now to FIG. 1, the ribbon cartridge is preferably of a molded plastic construction and is mainly comprised of a housing portion 10 and an integral arm portion 12. A ribbon cartridge support 14 is mounted on a right side frame 15. The housing 10 is inserted between an upper flange 118 shown in phantom and a lower flange. A suitable locking finger 16 engages the cartridge housing portion 10 to hold the cartridge in an installed position. A lever 17 is operable to release the locking finger 16 for removing the cartridge from the machine. A spring 19 is suitably connected to anchor 126 on the support flange 118 and post 122 in elongated slots 116 in upper support flange 118 and the lower flange (not shown) for biasing the cartridge in the cartridge removal direction to assist in removing the cartridge from the machine. The cartridge, when in the installed position, is located just in front of the platen 18 and substantially within the confines of a conventional typewriter configuration. The arm 12 extends from the housing 10 to the left to a terminal end 20 just beyond the print point 22 defined by a type guide 23. The terminal end 20, guides the ribbon 34 with sufficient stability to act as a ribbon vibrator. A ribbon vibrator as is well known in the business machine art must necessarily confine and retain the ribbon during the normal operation of the machine to impart the rapid, oscillating movements to the ribbon to raise the ribbon to a position at which it is struck by the type bar and to lower the ribbon to a rest position below the print point of the machine to allow visibility of the typed character. Thus in the present invention, the cartridge guides the ribbon 34 by way of the arm 12 to the print point 22 and eliminates the need of threading the ribbon 34 into a vibrator and thereafter placing separate spools into the machine ribbon spool support cups as encountered with the more conventional cartridge systems.

Figure 2:
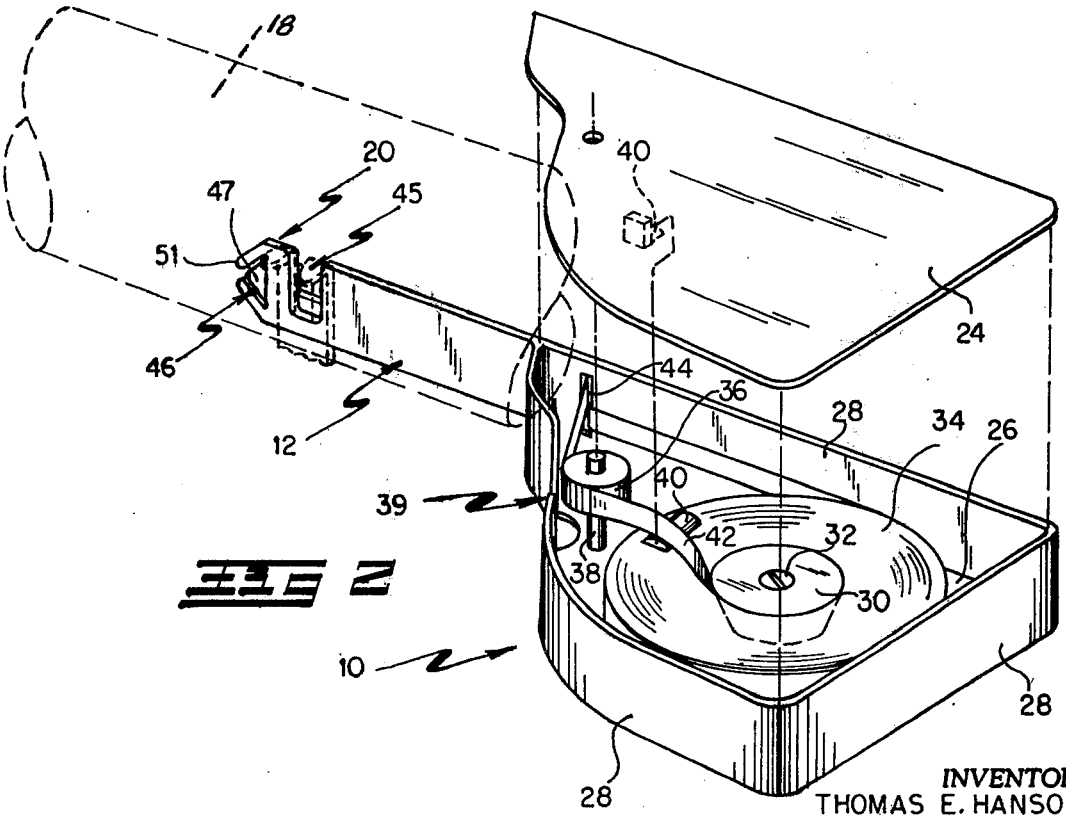
FIG. 2 is a right front perspective view of the cartridge having the top exploded therefrom illustrating its use with an endless type ribbon.

Referring now to FIG. 2, the housing 10 is comprised of a top cover 24, a bottom cover 26, and a perimetric wall 28. An endless ribbon hub 30 which is shaped as a partial cone having its smaller diameter adjacent the bottom cover 26, is rigidly mounted to the bottom cover 26 by a screw 32 for supporting an endless ribbon 34 at its inner convolution. A roller 36 is pivotally mounted on a post 38 which in turn is rigidly mounted at its ends to the top and bottom covers 24 and 26 respectively. The roller 36 is in close proximity to an opening 39 in the perimetric wall 28.

A semicircular finger 40 is molded to the under side of the top cover 24 for the purpose of guiding the ribbon portion 42 out from its inner convolution when it is pulled from the periphery of hub 30. An opening 44 is provided within the rear portion of the perimetric wall 28 near the point at which the arm 12 joins the housing 10. The arm 12 has an opening or print point aperture 45 slightly inward from the terminal end 20 and in vertical alignment with the print point 22 (see FIG. 1) when the cartridge is positioned in the machine. The arm 12 also has a V-shaped aperture 46 to provide a guide 47 having two substantially 45° surfaces 49a and 49b and has an opening 51 at the extreme end thereof leading into aperture 46.

The ribbon loop, which extends from its inner convolution over the finger 40, lies against a portion of the periphery of roller 36 and egresses from within the housing 10 through the upper portion of the perimetric wall opening 44. Thereafter it extends in an upper path of travel along the upper rear surface of arm 12 and behind cartridge print point or the arm opening 45, then forward and around the upper surface 49a downwards and rearward around the lower surface 49b to a lower path of travel back to the housing 10 along the lower portion of arm 12, then through the lower portion of opening 44 and on to the outer convolution of the ribbon supply 34. The ribbon 34 can be incrementally advanced along this fixed or constant path of travel by an appropriately driven feed roller 50 sandwiching the ribbon 34 against roller 36.

The cartridge print point or opening 45 in the arm 12 provides access to the ribbon 34 for a conventional typebar as it enters the type guide 23 (FIG. 1) in response to a normal machine operated typing action.

Figure 3:
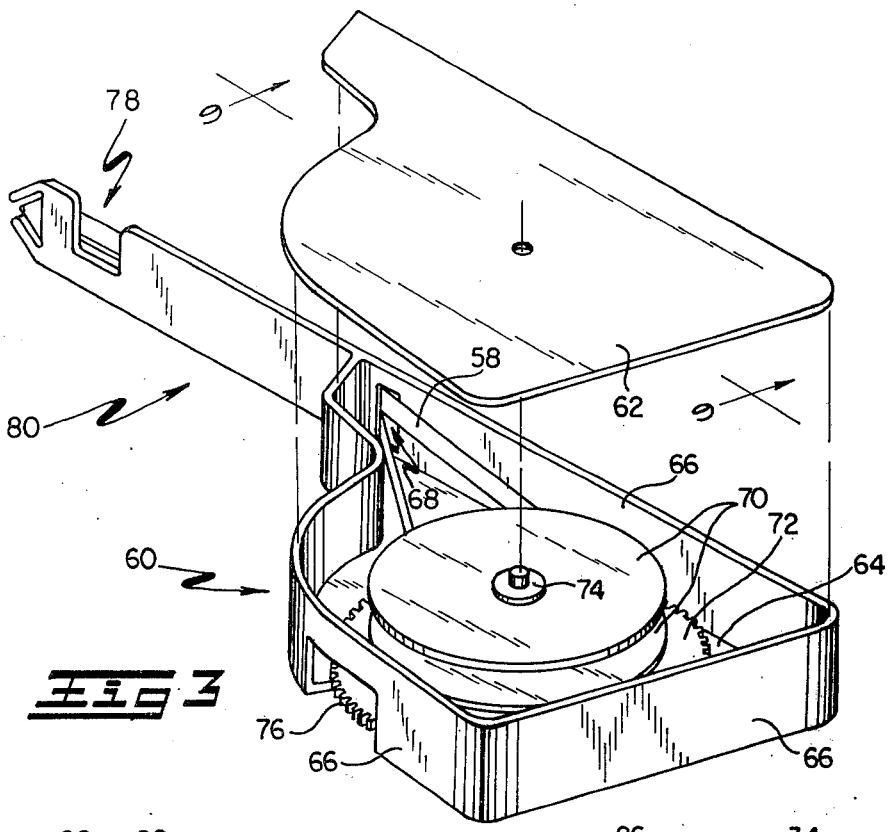
FIG. 3 is a view similar to FIG. 2 illustrating use of the cartridge with a double coaxially mounted spool for a conventional ribbon.

Referring now to FIG. 3, a second housing embodiment is shown to accommodate a double ribbon spool system for supporting a conventional ribbon 58. The housing 60 is substantially the same in construction as the housing 10 for the endless ribbon system as it has top and bottom covers 62 and 64 respectively and a perimetric wall 66 with a ribbon egress-ingress opening 68. The supply spool 70 and the take-up spool 72 are coaxially and pivotally mounted on a hub 74 which is rigidly mounted between the top and bottom covers 62, 64. The lower or take-up spool 72 is provided with teeth 76 on the periphery of its lower flange for mating with a suitable drive gear (not shown) when the cartridge is inserted into the machine cartridge support 14.

The upper and lower spools 70 and 72 respectively are pivotal with respect to each other and ribbon 58 is guided in a fixed or constant path of travel from the housing 60 to the print point 22 near the terminal end of the arm 80 in the same manner as in the endless ribbon system cartridge embodiment.

It will be evident that the drive gear (not shown), which may incrementally rotate clockwise in response to typing actions will effect a like counterclockwise rotation of the take-up spool 72 and the ribbon 58 will in turn be incrementally fed from right to left behind the cartridge print point or arm opening 78 and past the print point 22 of the typewriter when the cartridge is installed in the typewriter.

Figure 4:
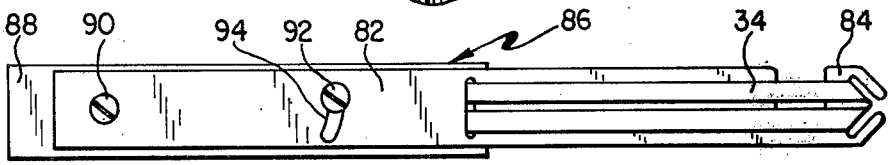
FIG. 4 is a rear elevational view on a reduced scale of the cartridge showing a second embodiment of the cartridge arm.
Figure 5:
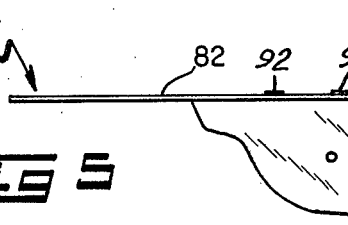
FIG. 5 is a top plan view of FIG. 4 to a reduced scale.

FIGS. 4 and 5 illustrate an alternate embodiment of the cartridge arm which may be employed with either the endless loop or double spool ribbon system. The arm 82 is constructed the same at its terminal end 84 and extends from the housing 86 the same distance as the previously described arm 12. However, the arm 82 instead of being molded integrally to the housing 86, extends behind the housing rear wall 88 and is pivotally mounted to this wall 88 by a shoulder screw 90. The arm 82 is guided for oscillating movement about the screw 90 with respect to the housing wall 88 by a pin 92 which is rigidly mounted to the housing wall 88 and extends through an arcuate arm slot 94. It will be evident that, when the cartridge is positioned within the machine, the arm 82 may be oscillated in response to typing actions by any suitable mechanism as would be common in oscillating a conventional machine ribbon vibrator and that such arm oscillations will not affect the fixed or constant path of travel of the ribbon 34 between the ribbon dispensing means in the housing 86 and the cartridge print point on the arm 82.

Figure 7:
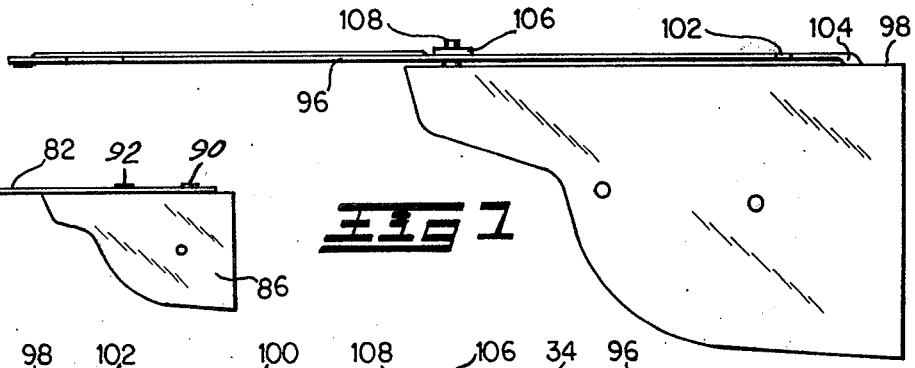
FIG. 7 is a top plan view of FIG. 6.
Figure 6:
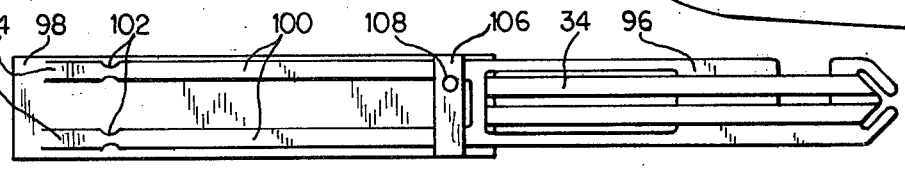
FIG. 6 is a view similar to FIG. 4 but showing a third embodiment of the cartridge arm.
Figure 8:
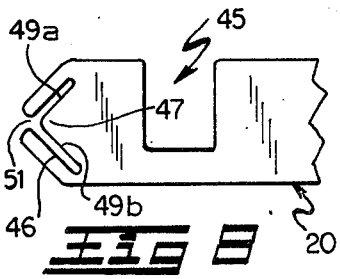
FIG. 8 is a front elevational view to an enlarged scale of the free end of the arm which is common to each arm embodiment.
Figure 9:
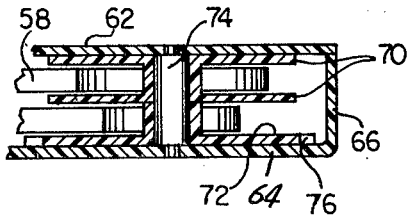
FIG. 9 is a partial front elevational view taken along line 9—9 of FIG. 3 showing a double spool construction.

FIGS. 6 and 7 illustrate still another arm embodiment wherein the arm 96 is integrally molded with the housing rear wall 98 by way of a pair of fingers 100. The fingers 100 are each provided with substantially necked down portions 102 near their joining point 104. The cartridge is molded from a material such as polypropylene for providing each finger 100 with a commonly known living hinge at the necked down portion 102. The living hinge feature of each finger 100 provides the arm 96 with the ability of being oscillated at its terminal end by the same conventional typewriter mechanism as would be used in accordance with the pivotal arm 82 shown in FIG. 4. The arm 96 (FIGS. 6 and 7) is guided for oscillation by a plate 106 which is spaced slightly away from the housing rear wall 98, by a pin 108 which is rigidly mounted to the plate 106 and the rear housing wall 98. The pin 108 also provides the limit for the oscillation movements.

Figure 10:
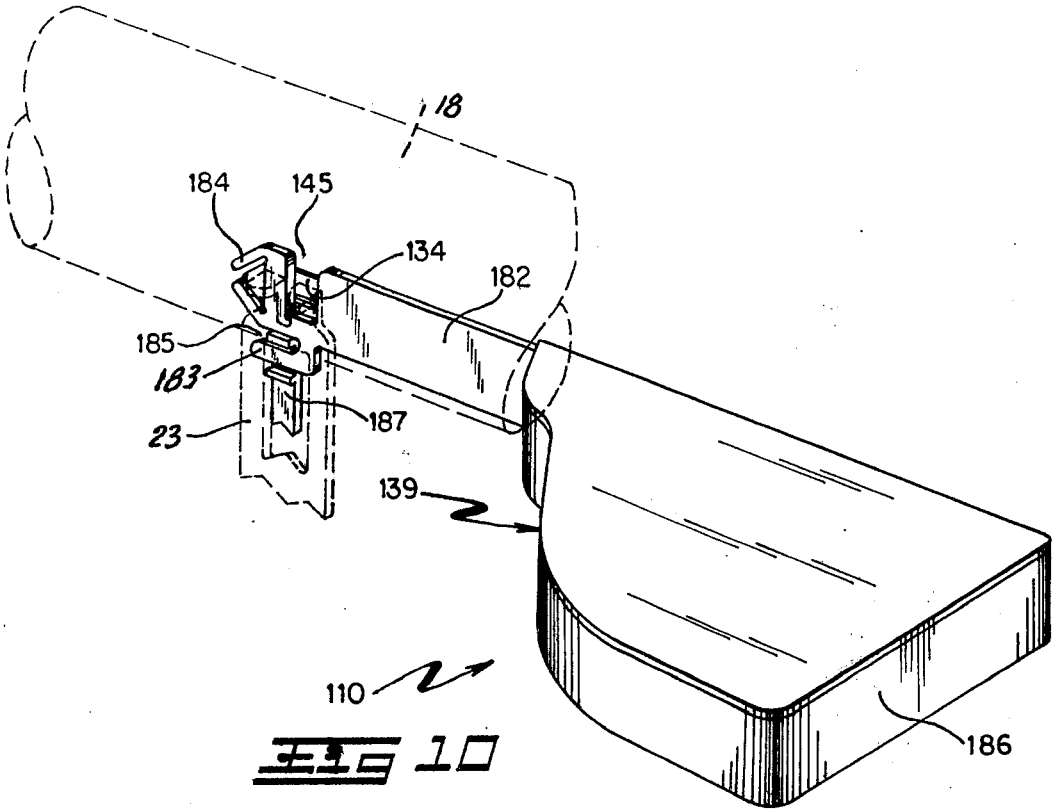
FIG. 10 is a right front perspective view of a modified cartridge having a pivotal arm in operative relationship with a typewriter lift mechanism.
Figure 11:
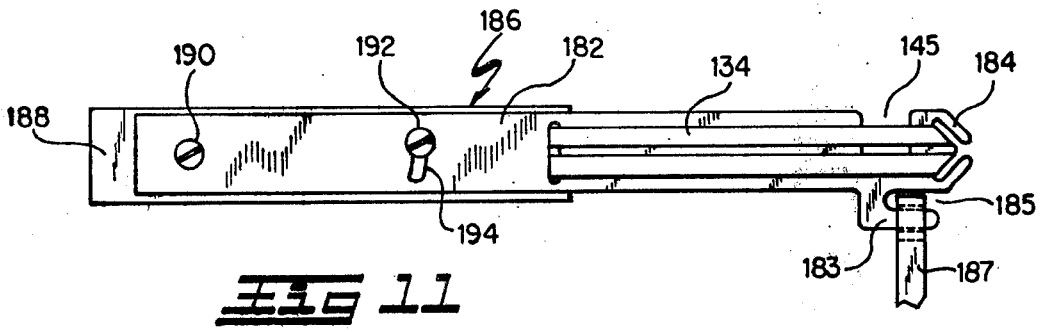
FIG. 11 is a rear elevational view of the cartridge of FIG. 4 but with its arm modified as in FIG. 10.

Referring next to FIGS. 10 and 11 there is shown an additional embodiment of the cartridge 110 having a housing 186 and a modified cartridge arm 182 with means near the end 184 thereof to engage a typewriter lift mechanism 187. The modified cartridge arm 182 may be used in either the endless loop or the double spool ribbon system although it has been shown in FIG. 10 in a housing 186 having an aperture 139 such as employed in an endless loop system as shown in FIG. 2. The cartridge 110 of FIGS. 10 and 11 includes a housing 186 having a cartridge arm 182 pivotally mounted to the rear wall 188 of the housing. The cartridge arm 182 is mounted on the housing 186 in the same manner as the cartridge arm 82 of FIGS. 4 and 5. Specifically, a screw 190 pivotally connects the cartridge arm 182 to the rear wall 188. Screw or pin 192 extends from the rear wall 188 of cartridge housing 186 through arcuate slot 194 in the cartridge arm 182. The pin 192 and arcuate slot 194 cooperate with the pivot pin 190 to maintain the cartridge arm 182 at a lateral orientation with respect to the cartridge housing 186 during rest conditions. The pin 192 and arcuate slot 194 further limit the pivotal movement of the cartridge arm 182 during a typing operation. Ribbon 134 extends from the cartridge housing 186 along the cartridge arm 182 to terminal end 184 of the cartridge arm 182 and is returned to the cartridge housing 186 in the same manner as previously described. The cartridge arm 182 of FIGS. 10 and 11 is further provided with a tab like portion 183 near its terminal end 184. The tab like portion 183 is L-shaped and projects downward from the print point opening 145 and toward the terminal end 184 of the cartridge arm 182 to form an open slot 185. Tab like portion 183 is located on cartridge arm 182 so that it will enter the channel provided in ribbon lift element 187 upon the insertion of the cartridge 110 into the typewriter when the cartridge arm 182 is maintained in a lateral orientation with respect to the housing 186 of cartridge 110.

During operation of the typewriter, the ribbon lift element 187 is lifted during each typing action to cause pivotal movement of the cartridge arm 182 with respect to the cartridge housing 186 thereby bringing the print point aperture 145 into alignment with the print point 22 (see FIG. 1) defined by typebar guide 23 of the typewriter. Thus the type bar (not shown) is permitted to strike the ribbon 134 and cause typing of the particular character. Element 187 is then returned to its rest position thereby lowering cartridge arm 182 and permitting visibility of the typed character.

Figure 12:
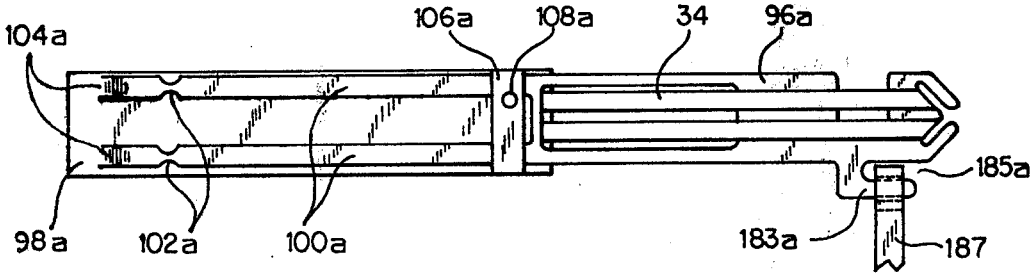
FIG. 12 is a rear elevational view of the cartridge of FIG. 6 but with its arm modified as in FIG. 10.

FIG. 12 shows a further embodiment of the cartridge arm generally indicated at 96*a*. This embodiment is substantially the same as the cartridge arm 96 of FIGS. 6 and 7 but further includes a tab like portion 183*a* defining slot 185*a* to permit the cartridge arm 96*a* to engage a typewriter lift mechanism 187 as was described with respect to the embodiment of FIGS. 10 and 11. Like the cartridge arm 96 of FIGS. 6 and 7 this embodiment may be used with either the endless loop or double spool ribbon system. The cartridge arm 96*a* is integrally molded with the housing rear wall 98*a* by way of fingers 100*a*. The fingers 100*a* are provided with substantially necked down portions 102*a* near their joining point 104*a*. The arm 96*a* is guided for oscillation by a plate 106*a* which is spaced slightly away from the housing rear wall 98*a* by a pin 108*a* which is rigidly mounted to the plate 106*a* and the rear housing wall 98*a*.

It can be seen from the aforementioned detailed description in reference to the accompanying drawing that the present invention provides a typewriter ribbon cartridge which clearly overcomes the disadvantages of the more commonly known separable type ribbon cartridges. More specifically, the present invention provides a ribbon cartridge which, to effect a ribbon installation within the machine, eliminates the need of having to thread the ribbon into the machine vibrator. This is accomplished by providing a cartridge with an arm for guiding the ribbon to a print point and back to the housing when the cartridge is positioned in the machine.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A ribbon cartridge removably mountable on a typewriter having a ribbon cartridge support, a print point and a ribbon lift mechanism, the ribbon cartridge comprising:

a housing;

means within the housing for supporting a ribbon;

an arm pivotally connected to and laterally extending from said housing comprising:

a print point fixed on said arm disposed for vertical registration with said typewriter print point; and means for guiding the ribbon from the housing on one side of the arm print point to the arm print point and thereafter guiding the ribbon back to the housing on the same side of the arm print point;

means on said arm for engaging said lift mechanism in said typewriter for moving said ribbon at said cartridge arm print point during operation of said typewriter from a first position removed from said typewriter print point to a second position wherein a portion of said ribbon is in alignment with said typewriter print point and back to said first position; and said means on said arm for engaging said typewriter lift mechanism comprises a tab-like extension of said arm integral therewith and having a slot therein for engagement with said typewriter mechanism when said cartridge is inserted into said cartridge support.

2. A ribbon cartridge according to claim 1 wherein said tab-like extension includes a portion extending laterally in the direction of insertion of said cartridge into said typewriter.

3. A ribbon cartridge constructed to be readily inserted into and readily removed from a typewriter, said cartridge comprising:

a housing having means for supporting a ribbon;

an arm carried by said housing, said arm having:

a single print point fixed on said arm;

means for guiding the ribbon from the housing on one side of said arm print point to said arm print point and thereafter guiding the ribbon back to the housing on the same side of said print point for enabling said ribbon to be installed and removed without manipulation thereof; and means for exposing a portion of said ribbon at said single print point of said arm.

4. The ribbon cartridge according to claim 3 wherein said means for exposing a portion of said ribbon, exposes the ribbon only at said single print point.

5. The ribbon cartridge according to claim 3 wherein said means for exposing a portion of said ribbon is an aperture formed in said arm.

6. The ribbon cartridge according to claim 5 wherein said aperture exposes only a portion of said ribbon at said print point.

7. The ribbon cartridge according to claim 3 including means for advancing said ribbon.

8. The ribbon cartridge according to claim 3 including means for incrementally advancing said ribbon.

9. A ribbon cartridge constructed to be readily inserted into and readily removed from a typewriter, the cartridge comprising:

a housing having means for supporting a ribbon;

an arm carried by said housing, said arm having a single print point fixed on said arm;

means for guiding the ribbon from the housing on one side of said print point to said arm print point along a first path and thereafter guiding the ribbon back to the housing on the same side of said print point along a second path in vertical relation to said first path for enabling said ribbon to be installed and removed without manipulation thereof, and means for exposing a portion of said ribbon at said print point of said arm.

10. The ribbon cartridge according to claim 9 wherein said means for exposing includes an aperture for exposing, in one of said paths, only a portion of said ribbon at said single print point.

11. The ribbon cartridge according to claim 10 wherein both of said paths are along and adjacent one face of said arm.

12. The ribbon cartridge according to claim 9 including means for advancing said ribbon.

13. The ribbon cartridge according to claim 9 including means for incrementally advancing said ribbon.

14. The ribbon cartridge according to claim 9 wherein said means for exposing a portion of said ribbon is an aperture formed in said arm.

15. The ribbon cartridge according to claim 14, wherein said aperture exposes only a portion of said ribbon at said print point.

16. The ribbon cartridge according to claim 9 wherein both of said paths are along and adjacent one face of said arm.

17. A ribbon cartridge constructed to be readily inserted into and readily removed from a stationary support on a typewriter having a ribbon lift mechanism, the cartridge comprising:

a housing having means for supporting a ribbon;

an arm carried by said housing, said arm having:

a print point fixed on said arm;

means on said arm for engaging said ribbon lift mechanism;

means for guiding the ribbon from the housing on one side of said arm print point to said arm print point and thereafter guiding the ribbon back to the housing on the same side of said print point for enabling said ribbon to be installed and removed without manipulation thereof, and means for exposing a portion of said ribbon at said print point of said arm.

18. The ribbon cartridge according to claim 17 including means for advancing said ribbon.

* * * * *